US007195553B2

(12) United States Patent
Knight

(10) Patent No.: US 7,195,553 B2
(45) Date of Patent: Mar. 27, 2007

(54) GRINDING MODULE

(75) Inventor: James H. Knight, Lawrenceville, GA (US)

(73) Assignee: Amanda Patent and Licensing SIA, Riga (LV)

( * ) Notice: Subject to any disclaimer, the term of this patent is extended or adjusted under 35 U.S.C. 154(b) by 0 days.

(21) Appl. No.: 11/159,401

(22) Filed: Jun. 23, 2005

(65) Prior Publication Data

US 2006/0292971 A1 Dec. 28, 2006

(51) Int. Cl.
*A22C 21/02* (2006.01)

(52) U.S. Cl. ..... 452/93

(58) Field of Classification Search ..... 452/87–91, 452/93, 94; 15/DIG. 2, 97.3, 230.14, 230.15, 15/230.16, 230.17, 230.19
See application file for complete search history.

(56) References Cited

U.S. PATENT DOCUMENTS 4,338,698 A * 7/1982 Beer et al. ..... 15/230.16
4,815,158 A * 3/1989 Crotts ..... 15/53.2
5,461,745 A * 10/1995 Nittoli ..... 15/97.3
6,267,660 B1 * 7/2001 Jespersen ..... 451/550

* cited by examiner

*Primary Examiner*—Thomas Price
(74) *Attorney, Agent, or Firm*—Dykema Gossett PLLC

(57) ABSTRACT

A grinding module for a rotating grinding brush includes an elongate body part, at least one abrasive cloth extending from the body part, and a plurality of bristles projecting from the body part essentially in the same direction as the abrasive cloth, the abrasive cloth being divided into a number of sub-segments that are delimited by slits, the abrasive cloth being configured with different distances between the slits so that sub-segments have at least two different widths. Hereby an abrasive cloth is provided which is configured for cooperating with a grinding module for a rotating grinding brush, whereby, during the mounting procedure, the operator avoids having to ascertain that abrasive cloths with a relevant type of sub-segments are mounted in a correct sequence on the hub. Thus, the operator needs to focus only on having to provide a specific type of abrasive cloth, following which the mounting procedure proceeds without problems and without having to take into consideration a desired sequence around the hub.

10 Claims, 3 Drawing Sheets

GRINDING MODULE

BACKGROUND OF THE INVENTION

1. Field of the Invention

The present invention relates to a grinding module for a rotating grinding brush, said grinding module comprising an elongate body part, at least one abrasive cloth that extends from the body part, and a plurality of bristles that project from the body part essentially in the same direction as the abrasive cloth; wherein said abrasive cloth comprises a holder for securing the abrasive cloth, said abrasive cloth being divided into a number of sub-segments that are delimited by slits; wherein the body part and the holder are provided with complementary mechanical interconnecting means, whereby the abrasive cloth is releasably mounted on the body part.

2. The Prior Art

Today, rotating grinding brushes are configured from a hub with longitudinally extending grooves in which grinding modules with an abrasive cloth and bristles, be it assembled or separate, are mounted by being displaced axially into the grooves. That kind of abrasive cloth is known from eg WO 2004/103643.

In that structure the abrasive cloth lends itself for use in the grinding of essentially plane workpieces of eg wood, metal or plastics material and which are eg provided with profiles, various types of cut-outs or edge profiles. Depending on the grinding job in question, different types of abrasive cloths having different grinding characteristics can be used on the same hub, and thereby a very particular grinding effect is accomplished. This is preferably accomplished by adaptation of the kind of grinding material, abrasive grains or grain sizes of the abrasive grains to the concrete grinding job. Moreover, it is known to configure the abrasive cloths with one particular distance between the slits in order to provide a particular characteristic grinding feature which is unique to the concrete grinding job. Such distance between the slits is defined as a sub-segment. Thus, an abrasive cloth having short distance between the individual slits will be particularly suitable for grinding of areas on a workpiece having an uneven (ie profiled) surface, and likewise an abrasive cloth having a long distance between the individual slits will be advantageous for use in the grinding of the rather plane areas of the workpiece, not in the least for "edge-breaking", ie the edges are rounded to remove any square transitions.

In order to facilitate the task of the operator, a process is employed that alternates between mounting of grinding brushes on the hub and grinding paper of a very particular characteristic, which most often has the practical consequence that the sub-segments on the abrasive cloth are made with a distance between the slits that is specific to precisely that abrasive cloth. Thus, the hub many alternatingly around its entire circumference be provided with different abrasive cloths, each of which is configured with one specific distance between the individual slits. Moreover the individual abrasive cloth may have a very particular grinding characteristic which is determined by eg the type and the extent of wear of the abrasive cloth.

In particular by alternatingly providing the cloth with abrasive cloths with different distances between the slits, a desired grinding characteristic for the grinding job in question is accomplished. Moreover, it is not possible to change every other abrasive cloth to maintain a constant speed of rotation on the grinding drum. However, there is a problem in connection with the mounting of the individual abrasive cloth; viz that the fitter has to take care to mount the various abrasive cloths correctly in the correct sequence on the hub, if the desired grinding characteristics are to be achieved. This requires careful attention on the part of the fitter, and likewise subsequent verification of the correct positioning of the individual abrasive cloths may be required.

It is therefore an object of the invention to provide an abrasive cloth configured for cooperating with a grinding module for a rotating grinding brush, whereby the problems of the prior art are obviated.

SUMMARY OF THE INVENTION

This is accomplished by the invention wherein the abrasive cloth is divided into a number of sub-segments that are delimited by slits having differing distances therebetween to provide sub-segments of at least two different widths. Hereby an abrasive cloth is used which is configured for cooperating with a grinding module for a rotating grinding brush, where, during the mounting procedure, the operator avoids having to ascertain that abrasive cloths of a relevant type of sub-segments are mounted in a correct sequence on the hub and having to exchange every other grinding segment. By the invention, the operator needs to focus only on having to provide a specific type of abrasive cloth, following which the mounting may take place without problems and without having to take into consideration a desired sequence around the hub.

Moreover the invention enables that it is avoided, in particular situations, to have to exchange every other grinding module and moreover that it is ensured that an abrasive cloth featuring the correct sub-segments is arranged in its right place in the sequence of segments. Hereby new and used grinding modules alternate on the hub at all times, and hereby it is possible to grind with the same speed of rotation on the rotating grinding brush.

The invention will now be explained with reference to the accompanying drawings.

DETAILED DESCRIPTION OF THE PREFERRED EMBODIMENT

Figure 1A:
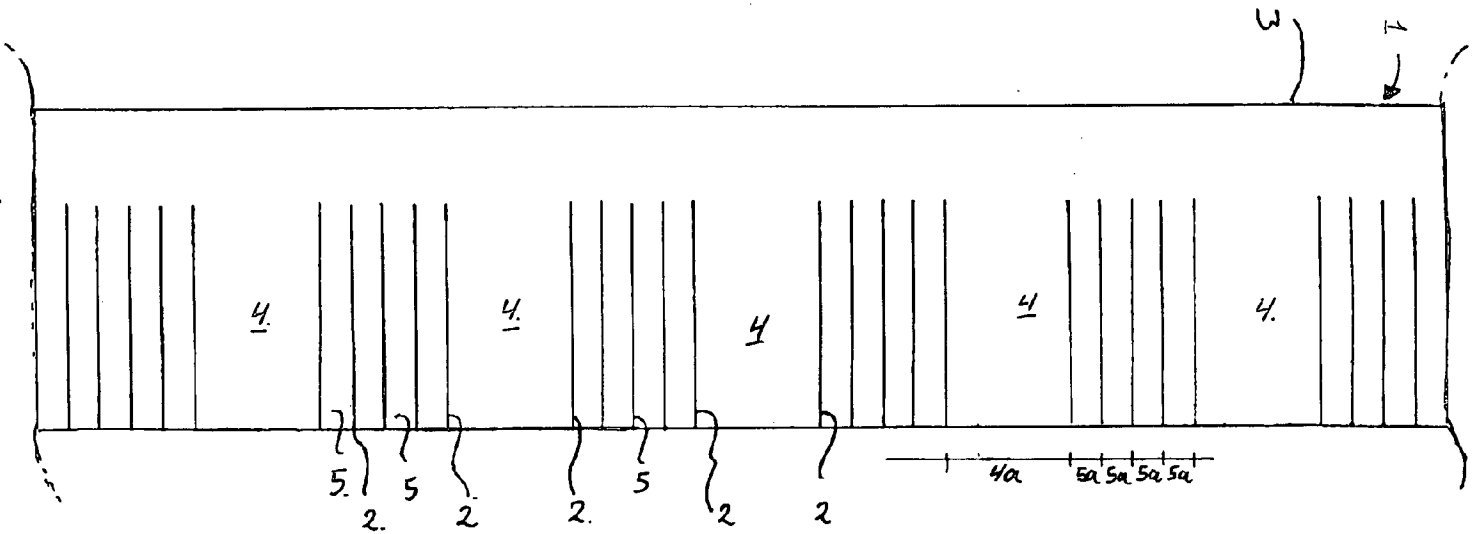
FIGS. 1*a*–1*c* show various embodiments of an abrasive cloth according to the invention.
Figure 1B:
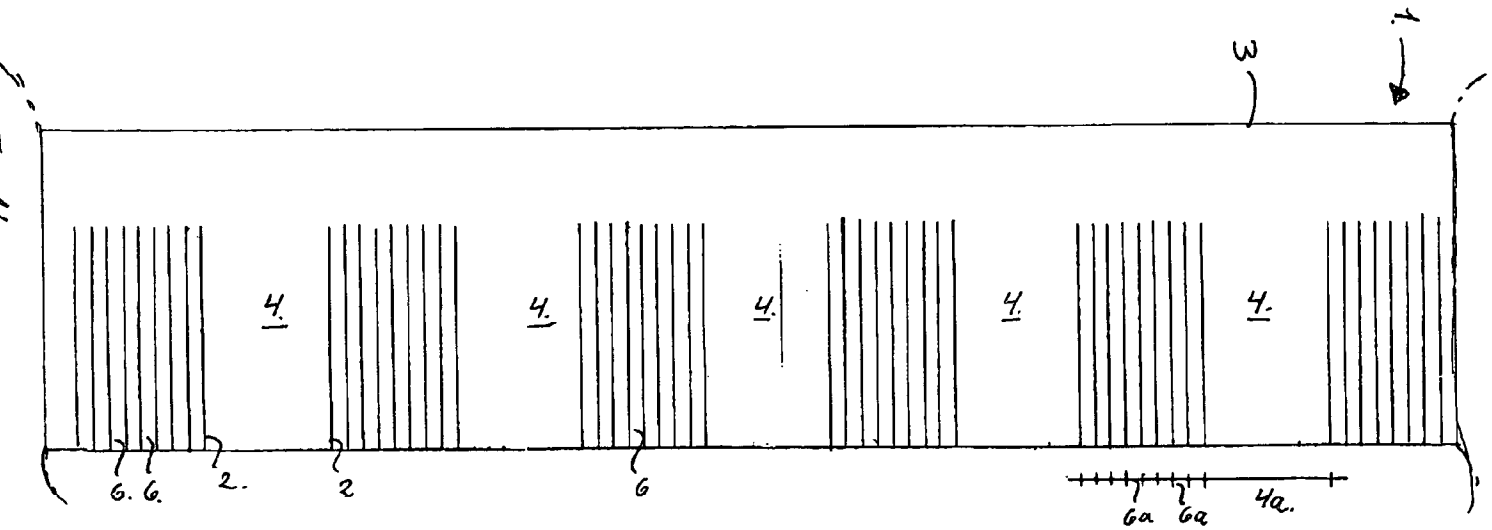
Figure 1C:
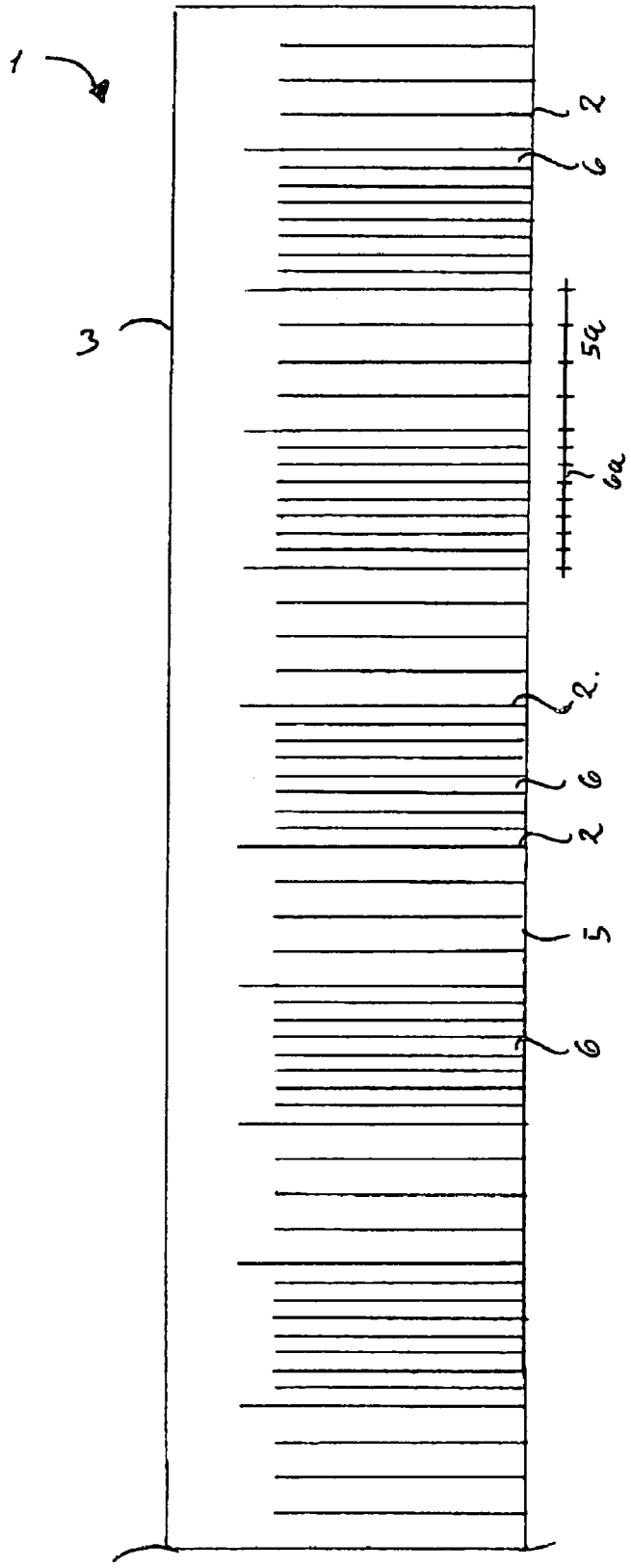

Thus, FIGS. 1*a*–1*c* show sections of various embodiments of the abrasive cloth 1 according to the invention and comprising a longitudinally extending edge 3 intended for securing of a holder 14, which will be subject to closer description below. The abrasive cloth is made of eg a fabric material, being on a surface provided with an abrasive material, such as eg abrasive grains. The abrasive cloth 1 comprises a number of sub-segments 4, 5, 6 by slitting of the abrasive cloth 1 essentially at right angles to the longitudinally extending edge 3.

Slitting of the abrasive cloth 1 with a specific distance between the individual slits 2 provides sub-segments 4, 5, 6 with a width that is determined by the distance between two slits 2 and as indicated by respective reference numerals 4*a*, 5*a*, 6*a*. Preferably the slits 2 are provided alternatingly in groups of one or more sub-segments 4, 5, 6 wherein the sub-segments 4, 5, 5 of each group are provided with the same distance between the slits 2. Those groups of sub-segments 4, 5, 6 are made in a general modular system, wherein each group of one or more sub-segments 4, 5, 6 has essentially the same expanse. Each group is divided by slitting into a desired number of sub-segments of between two and 16, and preferably between four and eight sub-segments, or the group may be undivided, ie there is exclusively one sub-segment in a group.

Preferably, the abrasive cloth 1 will be slit into sub-segments 4, 5, 6 with a distance of 3, 6, 12 or 24 mm between the individual slits 2 in a group.

Figure 2A:
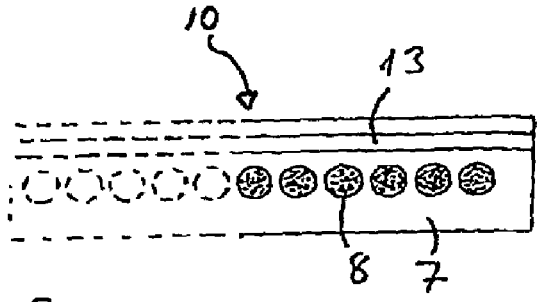
FIGS. 2*a* and 2*b* show a grinding module for use in combination with the abrasive cloth according to the invention.
Figure 2B:
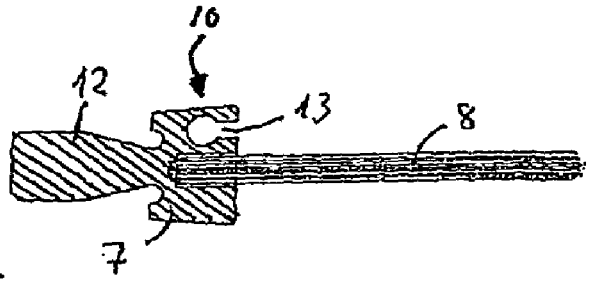

Thus, FIGS. 2*a* and 2*b* show a grinding module 10 for use in combination with the abrasive cloth. In FIG. 2, the abrasive cloth 10 is shown radially from the outside, the view being downwards towards the bristles 8, and FIG. 2*b* shows a cross-sectional view of the grinding module 10. The dotted left part of the grinding module 6 shown in FIG. 2*b* shows merely that the length of the grinding module 6 may, of course, be adapted to any given situation. Bristles 8 are mounted in the body part 7 of the grinding module 10, and in practice they will radiate at a slight angle from the site of attachment in the body part 7. For the sake of overview, however, FIG. 2*a* presents a view as if the bristles 8 form cylindrical batches of bristles. The bristles 8 may be mounted in the body part 7 in any known manner.

Apart from being provided with bores for attachment of bristles 8, the body part 7 of the grinding module 10 is also provided with a coupling part 12 that projects from the body part in a direction opposite that of the bristles 8. The coupling part 12 is configured such that it fits into the groove on the known, not shown hub. Thus, the grinding module 10 can be mounted on the known hub by displacement of the coupling part 12 axially into the groove of the hub as described above with respect to the prior art. If a hub is used that features differently configured grooves, the coupling part 12 will, of course, also be configured differently.

Figure 3:
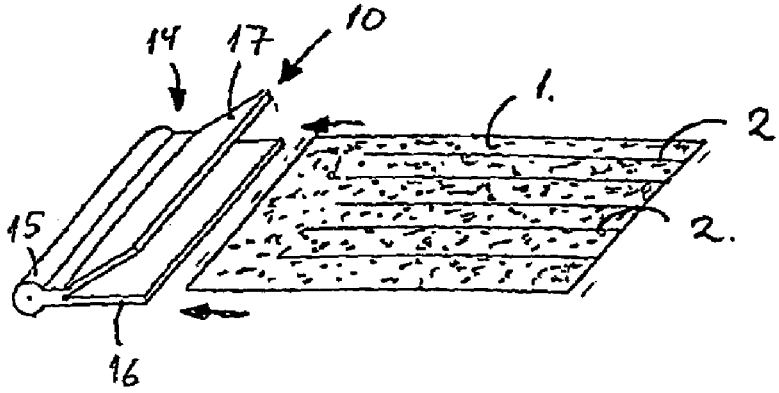
FIG. 3 is a perspective view of a holder for abrasive cloth holding an abrasive cloth.

FIG. 3 shows a perspective view of the body part 7 which is provided with an undercut, longitudinally extending groove 13 for mounting of a holder 14 with a piece of abrasive cloth 9 according to the prior art. At the one side the holder 14 is configured with a longitudinally extending bead 15 configured to cooperate with the groove 13 in the body part 7 of the grinding module 10. Opposite the longitudinally extending bead 15 the holder is configured with two flaps 16, 17 that are configured in a V-shape in relation to each other.

When the abrasive cloth 1 is mounted in the holder 14, the edge 3 thereof is arranged between the two flaps 16, 17 which are subsequently pressed towards each other and clamp the abrasive cloth 1 between the flaps 16, 17.

According to a further aspect the invention relates to an abrasive cloth configured for cooperating with a grinding module for a rotating grinding brush, said grinding module comprising an elongate body part, at least one abrasive cloth that extends from the body part, and a plurality of bristles that extend from the body part essentially in the same direction as the abrasive cloth; wherein said abrasive cloth comprises a holder with at least one elongate flap for attachment of the abrasive cloth, said abrasive cloth being divided into a number of sub-segments, said sub-segments being delimited by slits, and wherein the body part and the abrasive cloth are provided with complementary mechanical interconnecting means thereby releasably mounting the abrasive cloth on the body part.

Above, the invention was described with reference to a preferred embodiment of the grinding module and the grinding brush. However, several structural details may be varied without departing from the scope of this invention. For instance, the holder with the abrasive cloth may be secured to the brush profile by means of an adhesive, or the abrasive cloth and/or the holder with abrasive cloth may be cast integrally with the brush profile. Moreover, the abrasive cloth can be configured with a distance between the individual sub-segments. According to an alternative embodiment the grinding module may be cast directly in the hub.

With regard to choice of material for the individual parts, the options are numerous. The grinding module as such will typically be manufactured from extruded aluminium or plastics, whereby it may, in principle, be manufactured in an endless length that can be cut-off as desired. The holder for the abrasive cloth will preferably be manufactured from an inexpensive metal, its longevity being, as it is, limited.

The invention claimed is:

1. A grinding module for a rotating brush, said grinding module comprising an elongate body part, at least one abrasive cloth having abrasive material on one side thereof and extending from the body part, and a plurality of bristles projecting from the body party essentially in the same direction as the abrasive cloth;

said abrasive cloth being divided into a number of sub-segments that are delimited by slits, wherein that the abrasive cloth is provided with different distances between the slits, whereby an abrasive cloth is provided that has sub-segments of at least two different widths.

2. A grinding module according to claim 1, wherein sub-segments with essentially the same distance between the slits are grouped with each other and adjoin at least one other sub-segment with a different distance between the slits.

3. A grinding module according to claim 1, wherein at least two sub-segments with essentially the same distance between the slits are configured in extension of each other.

4. A grinding module according to claim 1, wherein the slits extend essentially perpendicular to the edge of said abrasive cloth.

5. A grinding module according to claim 1, wherein the abrasive cloth comprises a holder for attachment of the abrasive cloth.

6. A grinding module according to claim 1, wherein the body part and the holder are provided with complementary mechanical interconnecting means, whereby the abrasive cloth is releasably mounted on the body part.

7. A grinding module according to claim 1, wherein the distance between two adjoining slits is comprised within the interval of from 3 to 24 mm.

8. A grinding module according to claim 7, wherein the distance between two adjoining slits is 3 mm.

9. A grinding module according to claim 7, wherein the distance between two adjoining slits is 6 mm.

10. An abrasive cloth for a grinding module which includes abrasive material on one side thereof and a plurality of slits that are spaced apart at least three different distances to provide sub-segments of at least three different widths.

* * * * *